US006205691B1

(12) United States Patent
Urda et al.

(10) Patent No.: US 6,205,691 B1
(45) Date of Patent: Mar. 27, 2001

(54) NEON-LIKE DISPLAY DEVICE

(76) Inventors: Susan L. Urda; Katherine M. Fyler, both of 17 Sherry La., Saddle Brook, NJ (US) 07663

( * ) Notice: Subject to any disclaimer, the term of this patent is extended or adjusted under 35 U.S.C. 154(b) by 0 days.

(21) Appl. No.: 09/255,530

(22) Filed: Feb. 22, 1999

(51) Int. Cl.[7] ..... G09F 13/02

(52) U.S. Cl. ..... 40/559; 40/579; 40/580; 40/581; 40/615

(58) Field of Search ..... 40/564, 579, 580, 40/581, 615, 559; 362/812

(56) References Cited

U.S. PATENT DOCUMENTS

| | | | | |
|---|---|---|---|---|
| 1,081,800 | * | 12/1913 | Wiley et al. | 362/812 |
| 1,651,429 | * | 12/1927 | Wineburgh | 40/580 |
| 2,850,823 | | 9/1958 | Sauer . | |
| 4,077,146 | * | 3/1978 | Nasgowitz | 40/564 |
| 4,285,889 | | 8/1981 | Parsons . | |
| 4,373,283 | * | 2/1983 | Swartz | 40/564 |
| 4,584,501 | | 4/1986 | Cocks et al. . | |
| 5,126,855 | | 6/1992 | Saito . | |
| 5,223,357 | | 6/1993 | Lovison . | |
| 5,345,705 | | 9/1994 | Lawrence . | |
| 5,536,558 | * | 7/1996 | Shelton | 40/559 X |
| 5,585,160 | | 12/1996 | Osthassel . | |
| 5,796,331 | * | 8/1998 | Lamparter | 40/564 X |
| 5,819,449 | * | 10/1998 | Molson | 40/615 |

* cited by examiner

*Primary Examiner*—Terry Lee Melius
*Assistant Examiner*—James M Hewitt
(74) *Attorney, Agent, or Firm*—Lawrence G. Fridman

(57) ABSTRACT

A display device resembling neon tubing includes a transparent substrate with one or more elongate, continuous grooves formed in the substrate from a rear surface thereof. The groove is shaped to represent an informational image, such as a letter, symbol, character or design, for communicating a message to a viewer. A layer of a roughness is formed within an arcuate groove surface of substantially constant diameter along the length of the groove to thereby uniformly disperse light that may be incident on the groove toward the front surface of the substrate in an arcuate path. A blocking layer covers the rear surface of the substrate adjacent the groove for permitting the transmission of light only through the groove to thereby create a sharp contrast between light incident on the groove and the blocking layer. The diameter of the groove is preferably approximately equal to the diameter of conventional neon tubing. With this arrangement, light incident along the length of the roughened, arcuate groove surface exits the front surface of the substrate in an arcuate path with substantially uniform intensity along the length of the groove to thereby create a three dimensional tubular appearance that is visually similar to neon tubing.

11 Claims, 3 Drawing Sheets

NEON-LIKE DISPLAY DEVICE

BACKGROUND OF THE INVENTION

1. Field of the Invention

This invention relates to advertising and promotional displays, and more particularly to displays that resemble neon tubing in appearance.

2. Description of the Related Art

An important purpose of advertising displays or signs is to describe or present a product, concept, or idea in a clear and attractive manner to persons within visual range of the display or sign. The more visually stimulating or attractive the display is, the more likely a person is to take notice to the advertisement. Displays with three-dimensional illuminated images are generally more visually stimulating than two-dimensional images.

One popular three-dimensional display used often in advertising includes neon signs, which feature illuminated glass tubing bent into letters and other shapes. Neon signs are notorious for their nostalgic, attractive appearance. The uniform light emanating from the tubing is pleasing to look at and contrasts sharply with dark background areas between the tubing. During manufacture of neon signs, glass tubing that typically comes in four-foot lengths with a about a one-half inch (approximately 12 mm) diameter, is heated and formed into the desired shape. Often, a letter or series of letters and/or shapes are constructed from a single glass tube so as to create a continuous one stroke design. In order to maintain uniform light intensity throughout the length of the tubing, great care must be taken to assure that the diameter remains constant, especially at sharp bends in the tubing. Great skill is therefore required during the shaping process. Once shaped, Neon gas is introduced into the tubing and the tubing is sealed. An electric charge applied to the gas at opposite ends of the tubing causes a characteristic intense glow along the length of the tubing. A special transformer must be used to apply the electric charge.

Although quite popular, neon signs often break during shipping and installation. The manufacture of neon signs is very labor-intensive and requires specialized skill. Consequently, neon signs are inherently expensive. The transformers are also expensive and often raise the price of the sign to a prohibitive level for small businesses or persons with limited advertising budgets. Neon signs are also generally heavy and difficult to mount.

In an effort to overcome some of the difficulties associated with neon signs, simulated neon signs have been developed. These prior art arrangements typically include a flat panel that is imprinted with advertising and illuminated with a fluorescent bulb from a back side of the panel. The printing process typically utilized in manufacturing of such signs is silk-screening, wherein special inks are pressed through a screen containing a negative blocking image. The resulting positive image imprinted on the panel is often bleared and milky in appearance when illuminated and cannot escape the impression of a flat two-dimensional surface. Although the silk screen inks can be applied to the surface with rounded edges, there is no depth or three-dimensional impression. Thus advertising arrangements produced by screen printing fail to generate three-dimensional impression on a viewer so typical and important for the neon tubing displays.

Other prior art signs are vacuum-formed so as to have a raised element that may appear somewhat like a neon tube. Again, the silk screening process typically used in manufacturing these types of signs results in a somewhat white, translucent milky appearance and therefore gives a more subdued look than neon. Furthermore, the vacuum-formation requires use of special machinery and equipment custom made for a particular sign. This makes signs and advertisements quite expensive especially for small advertisers having limited financial resources.

SUMMARY OF THE INVENTION

It is therefore an object of the present invention to provide a decorative promotional display resembling a neon sign.

It is a further object of the invention to provide a neon-like decorative promotional display which is relatively easy to manufacture and which is comparatively low in cost.

According to the invention, a display device resembling neon tubing includes a clear transparent substrate having a front surface and a rear surface with the front surface of the substrate being adapted to face a viewer, and one or more elongate, continuous grooves extending into the substrate from the rear surface. The groove is shaped to represent an informational image, such as a letter, symbol, character or design, for communicating a message to a viewer. A layer of roughness is formed within arcuate groove surface of substantially constant diameter along the length of the groove. This enables the invention to uniformly disperse light that may be incident on the groove toward the front surface of the substrate in an arcuate path. A blocking layer covers the rear surface of the substrate adjacent the groove delineating its borders and permitting the transmission of light only through the groove to thereby create a sharp contrast between light incident on the groove and the blocking layer. Preferably, the diameter of the groove(s) is at least approximately equal to the diameter of conventional neon tubing.

With the above-described arrangement, light incident along the length of the arcuate groove surface having the layer of roughness exits the front surface of the substrate in an arcuate path with substantially uniform intensity along the length of the groove to thereby create a three dimensional tubular appearance that is visually similar to neon tubing.

If desired, a colored, translucent layer may cover one or more selected grooves to thereby impart a color to the selected grooves when illuminated.

According to a further embodiment of the invention, a method for forming a display device resembling neon tubing comprises the steps of: providing a clear transparent substrate, forming a light blocking layer on the rear surface of the substrate, forming one or more elongate and continuous groove sections in the substrate through the light blocking layer into one or more shapes representing an informational image for communicating a message to a viewer. The layer of roughness is being formed within the surface of the groove. The groove surface is arcuate in cross section with a substantially constant diameter throughout the length of the groove. The light blocking layer permits the transmission of light only through the groove to thereby create a sharp contrast between light incident on the groove and the blocking layer. The groove surface having the layer of roughness uniformly disperses light that may be incident on the groove toward the front surface of the substrate in an arcuate path. In this manner, light incident along the length of the roughened, arcuate groove surface exits the front surface of the substrate in an arcuate path with substantially uniform intensity to thereby create a three dimensional tubular appearance that is visually similar to neon tubing. The step of formation of the layer of roughness within the groove surface may be performed simultaneously with the step of forming the groove.

A translucent layer may be applied over one or more selected grooves to thereby impart a color to the selected groove(s) when illuminated.

There are, of course, additional features of the invention that will be described hereinafter which will form the subject matter of the appended claims. Those skilled in the art will appreciate that the preferred embodiments may readily be used as a basis for designing other structures, methods and systems for carrying out the several purposes of the present invention. It is important, therefore, that the claims be regarded as including such equivalent constructions since they do not depart from the spirit and scope of the present invention. The foregoing and other features and advantages of the invention will be apparent from the following more particular description of preferred embodiments of the invention, as illustrated in the accompanying drawings.

BRIEF DESCRIPTION OF THE DRAWINGS

The preferred embodiments of the present invention will hereinafter be described in conjunction with the appended drawings which are intended to illustrate and not to limit the invention, where like designations denote like elements, and in which.

DETAILED DESCRIPTION OF THE PREFERRED EMBODIMENT

Figure 1:
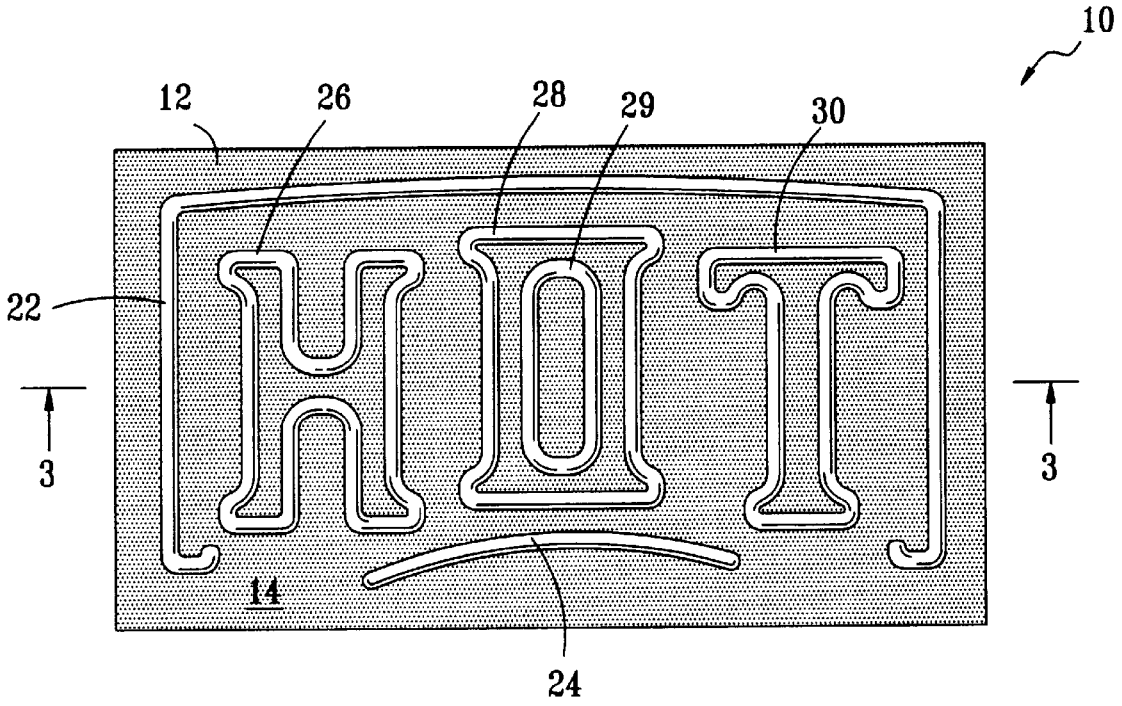
FIG. 1 is a front view of a neon-like display device according to the invention.
Figure 2:
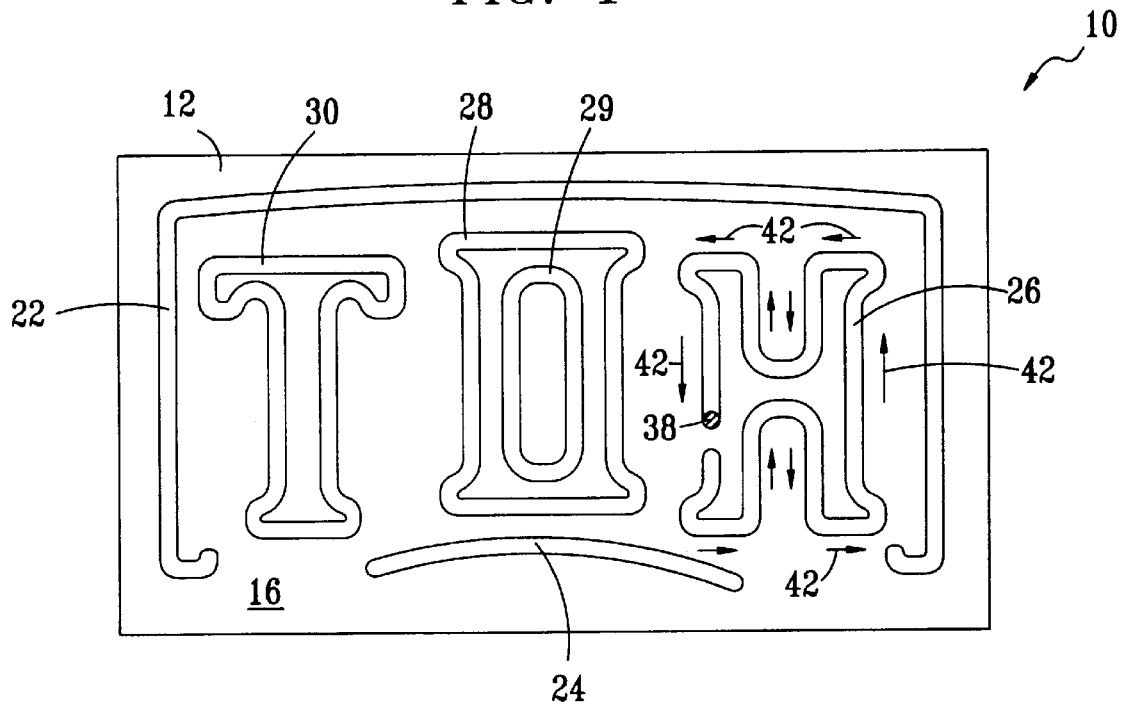
FIG. 2 is a rear view of the display device of FIG. 1.
Figure 3:
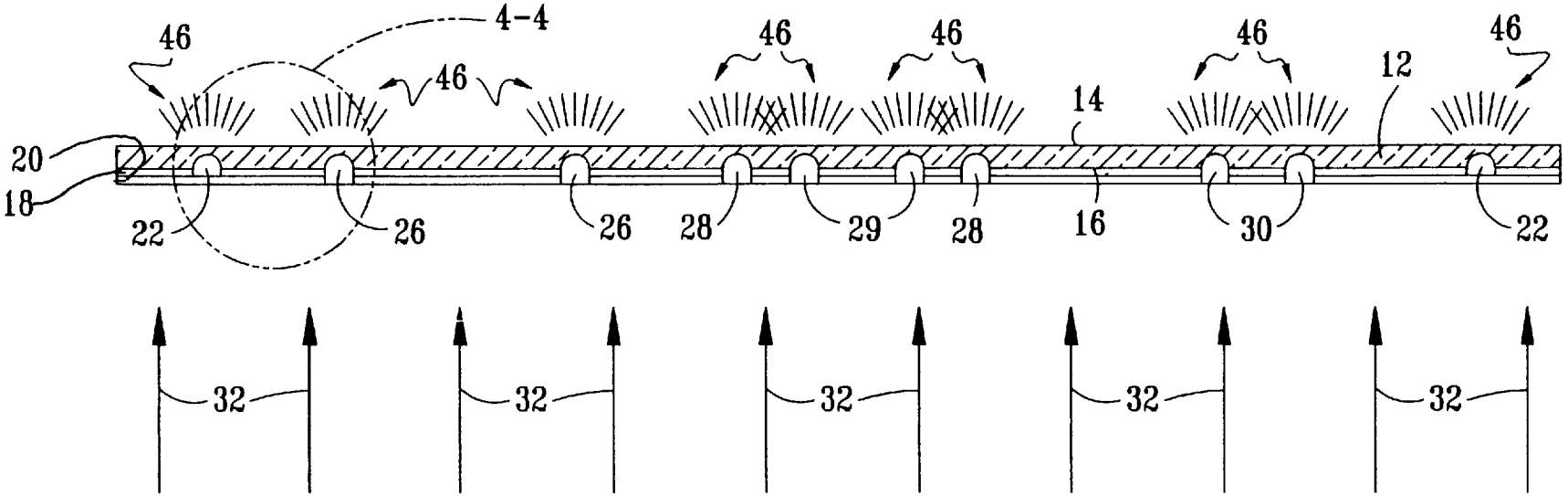
FIG. 3 is a cross-sectional view of the display device taken along line 3—3 of FIG. 1.

Referring now to the drawings, and to FIGS. 1 to 3 in particular, a neon-like display device 10 according to the present invention comprises a transparent substrate or panel 12 having a front surface 14 and a rear surface 16. A blocking layer 18 is located on the rear surface 16 and a translucent design layer 20 is positioned over the blocking layer. Design grooves 22, 24 and letter grooves 26, 28, 29 and 30 extend inwardly within the panel 12 from the rear surface 16. A light source (represented by arrows 32 in FIG. 3) is preferably directed toward the rear surface 16.

The panel 12 is preferably constructed of a transparent, flat material, such as plastic or glass, and can be cut to any desired shape. An acrylic-type material known as Lucite L is especially suitable for the panel 12, due to its flat, smooth front and rear surfaces, optical clarity, machinability, and relatively low cost. Although the neon-like effect is best obtained with flat front and rear surfaces 14 and 16, the panel 12 may be bent or curved to meet specific design needs and/or visual effects.

Figure 4:
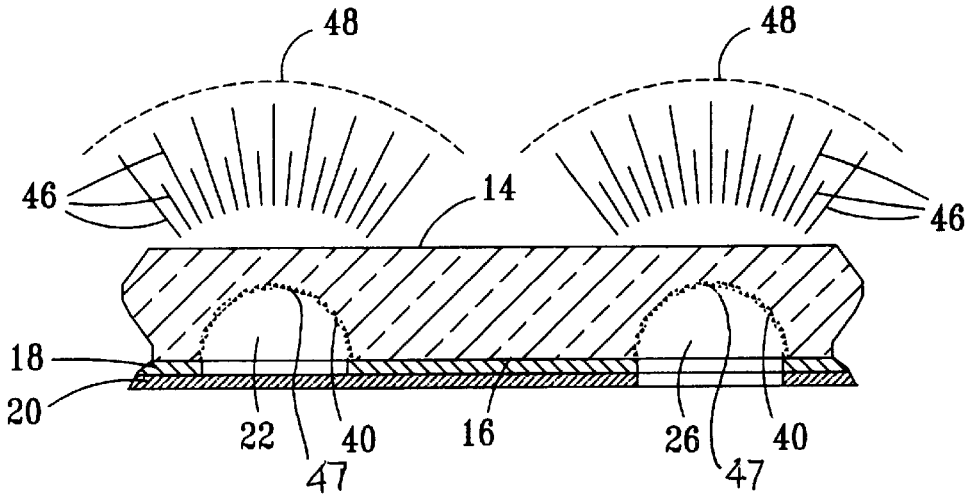
FIG. 4 is an enlarged cross-sectional view of the display device taken along line 4—4 of FIG. 3.

With additional reference to FIG. 4, the blocking layer 18 preferably comprises an adhesive-backed polymeric sheet, such as vinyl, and is applied to the rear surface 16 of the panel 12 prior to forming the grooves 22 to 30. The blocking layer is preferably completely opaque and initially covers the entire rear surface 16 prior to forming the grooves. In order to provide the enhanced contrast between the illuminated grooves and the background area surrounding the grooves, the blocking layer 18 can be of black color. However, the invention is not limited thereto, since other colors for the blocking layer 18 can be used for different visual effects. As an alternative to an adhesive-backed vinyl sheet, the blocking layer 18 can comprise paint, ink, foil, a separate opaque panel, or any suitable light blocking means applied to the rear surface 16 of the panel 12. The blocking layer 18 may be a combination of light blocking sheets, paint, ink, and so on, applied to the rear surface 16. It is to be understood that the term "blocking layer" as used herein can refer to a single layer or multiple layers with a single color or a plurality of different colors, as long as at least a substantial portion of light incident on the blocking layer is prevented from transmitting through the panel 12.

The translucent layer 20 is preferably constructed of an adhesive-backed translucent polymeric sheet that is applied over the blocking layer 18. However, the translucent layer 20 can alternatively comprise paint, ink, or any other light filtering means that permits only the transmission of one or more desired wavelengths of visible light through the panel 12 in areas where the panel is devoid of the blocking layer 18. In this manner, colored light is transmitted through the panel in at least some of the areas not blocked by the blocking layer 12. For example, and as shown most clearly in FIGS. 3 and 4, the blocking layer 18 does not extend over the design grooves 22 and 24 or the letter grooves 26, 28, 29 and 30, while the translucent layer 20 does extend over the design groove 22 (and design groove 24). Light projecting through the design grooves 22 and 24 can thus be made to radiate at a different color than light projecting through the letter grooves to thereby give the appearance that the design grooves are formed with a different colored neon light than the letter grooves. Of course, it is to be understood that the translucent layer may extend also over the letter grooves. Alternatively, different portions of the panel and/or grooves may be associated with different translucent colors so as to provide a desired visual effect. For example, the letter grooves 26, 28, 29 and 30 may be associated with a first color while the design grooves 22 and 24 are associated with a second color that is different from the first color.

The translucent layer 20 may be a combination of translucent sheets, paint, ink, or any combination thereof applied to the rear surface 16 of the panel, and/or the blocking layer 18, and/or one or more of the groove surfaces to give a desired visual effect. It is to be understood that the term "translucent layer" as used herein can refer to a single layer or multiple layers with a single color or a plurality of different colors, as long as light passes through such translucent layer. As an alternative to, or in addition to the translucent layer 20, the light source 32 can be prefiltered to transmit light in one or more colors before arriving at the panel 12.

The light source may include any one or combination of light emitting means, including but not limited to: fluorescent lights, incandescent bulbs, natural sunlight, electroluminescent sheets, light emitting diodes, halogen bulbs, and the like. Depending on the type of light source used, the panel 12 may be mounted to a housing (not shown) containing the light source.

Referring now to FIGS. 2 and 4, the design grooves 22, 24 and the letter grooves 26, 28, 29 and 30 are preferably formed within the panel 12 from the rear side 16 of the panel in a reverse orientation, so that the design grooves and letter grooves appear in their normal orientation when viewed from the front of the panel.

As best illustrated in FIG. 4, a groove surface 40 is formed having a semi-circular cross-section with a substantially uniform layer of roughness 47 along its interior surface and length. Such formation enables the invention to evenly disperse light throughout the groove and portions of the panel adjacent to the groove. In this manner, light passing through the grooves appears uniform. It has been found that the layer of roughness 47 in combination with the semi-circular or arcuate groove configuration is sufficient in many instances to create the uniform distribution of light resembling in appearance the three-dimensional tubing of the neon displays.

The grooves with the layer of roughness 47 can be formed, for example, by a core box bit 38 (shown in cross-section in FIG. 2 having a rounded tip). Although the use of core box bit for the formation of the grooves is being described hereinabove, it is to be understood that other tools and techniques can be used for forming the grooves and the roughened groove surfaces. For example, the grooves and groove surfaces may be formed by sanding, grinding, sandblasting, etching, carving, routing, and so on.

In addition to the layer of roughness 47, an important requirement of the groove surface is that it remains arcuate throughout its entire length. If the groove were to be formed, for example with a 45 degree bevel bit, very different and ineffective results would occur. The bevel bit would create two groove surfaces in a "V" shape, with each surface reflecting light in sharply contrasting different directions. Thus, two separate areas of light would be transmitted through the panel to give a flat or angled groove appearance that is very different than the desired three-dimensional tubular appearance. Depending on the viewer's position with respect to the front of panel 12, different views of the V-shaped groove would result in different visual effects. In contrast, the three-dimensional tubular effect obtained with the arcuate-shaped groove of the present invention is independent of a viewer's position with respect to the front of the panel.

Preferably, all of the grooves are formed after the blocking layer 18 is applied to the rear surface 16 of the panel 12. At least some of the grooves may be formed prior to applying one or more translucent layers 20, while the remaining grooves may be formed thereafter. By way of example, the design grooves 22, 24 are formed after application of the blocking layer 18 but before application of the translucent layer 20, while the letter grooves 26, 28, 29 and 30 are formed after application of both the blocking and translucent layers. In this manner, light transmitted to the letter grooves does not change color, while light transmitted to the design grooves is filtered through the translucent layer to thereby change the color of light emanating through the design grooves. The blocking layer provides a sharp contrast between the letter and design grooves when illuminated, since light that reaches the blocking layer is at least substantially blocked from reaching the panel 12.

In an alternative arrangement, the blocking layer and/or translucent layer may be formed in a separate operation with openings similar to the shape of the grooves and then attaching the layer(s) to the panel 12. In an even further embodiment, some or all of the grooves may be formed in the panel and then selectively masked prior to applying the blocking and/or translucent layers.

The layer of roughness 47 in combination with the arcuate groove surface assures the uniform distribution of light along the length of each groove causing light rays 46 to exit the front surface 14 of the panel in an arcuate path 48 (shown by a broken line in FIG. 4). All these create a soft glow that resembles illuminated neon tubing, even with the flat front surface 14 of the panel 12. The panel 12 should be chosen with an optical clarity that does not adversely affect the arcuate transmission of light through the thickness of the panel between the arcuate groove surface 40 and the front surface 14.

Each letter and/or design groove is preferably formed with continuous movement of the bit 38, as shown by direction arrows 42 in FIG. 2, to thereby create a groove style similar in appearance to neon tubing when it is bent into letters and/or design shapes from a single piece of tubing. The inner and outer radii of the groove at points where the groove direction changes are similar to the inner and outer radii of the neon tubing when bent in a similar direction. Thus, the resultant soft glow emanating from the roughened arcuate grooves, the size of the grooves and radii at bends in the grooves, as well as the continuous nature of the grooves contribute to creating the resemblance of a neon sign.

For relatively small display signs that are primarily intended to be used indoors, the diameter of the grooves is preferably substantially equal to the conventional diameter of neon tubing used for indoor displays. The typical diameter of neon tubing is approximately 10 mm to 12 mm. A suitable diameter for the grooves is in the range of about 8 mm to 15 mm, and preferably about 10 mm to 12 mm. Depending on the type of environment that the neon-like display device 10 is to be used in, as well as the predetermined proximity of a viewer to the display device, the diameter of the grooves, as well as the thickness and size of the panel may vary greatly.

Although specific shapes for the design grooves and a particular lettering style has been shown for the letter grooves, it is to be understood that the invention is not limited thereto. Any combination of design shapes and/or letters and words in any size can be formed in the panel 12.

Figure 5:
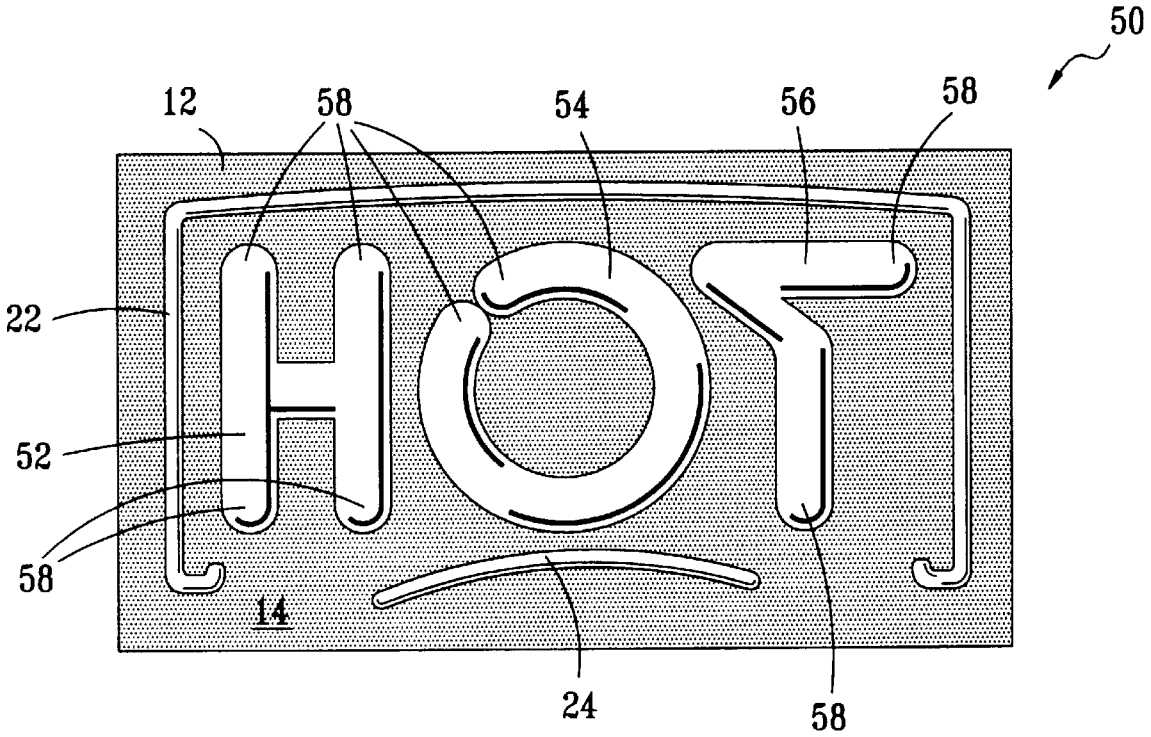
FIG. 5 is a front view of a neon-like display device according to a further embodiment of the invention.

With reference now to FIG. 5, a neon-like display device 50 according to a second embodiment of the invention is illustrated, wherein like parts in the previous embodiment are represented by like numerals. The display 50 is similar in construction to the display 10, (see FIGS. 1 and 2) with the exception that single, continuous letter grooves 52, 54 and 56 are formed in the panel 12. Each letter groove 52, 54 and 56 represents a different letter style that is shaped to more closely imitate the single continuous stroke styling of neon tubing formed into letters. As shown, each letter groove begins and ends with an arcuate portion 58, which is similar to the terminal ends of formed neon tubing. Although the design grooves 22 and 24 are shown as being smaller in diameter than the letter grooves 52, 54 and 56, any diameter for the design grooves and letter grooves can be chosen, depending on the size of the display device 50 and the proximity of a viewer to the display device.

It is to be understood that the terms "front" and "rear" and their respective derivatives as used herein describe relative, rather than absolute orientations.

While the invention has been taught with specific reference to the above-described embodiments, those skilled in the art will recognize that changes can be made in form and detail without departing from the spirit and the scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The embodiments for which an exclusive property or privilege is claimed are defined as follows:

1. A simulated neon tubing display device, comprising:

a clear transparent substrate having a front surface and a rear surface, the front surface of the substrate being adapted to face a viewer;

at least one elongate, continuous groove extending into the substrate from the rear surface, the groove being shaped along a length thereof to represent an informational image for communicating a message to a viewer, a surface of the groove being substantially arcuate in cross-section with a substantially constant diameter throughout at least a substantial length of the groove, the groove surface being formed with a uniform layer of roughness, the front surface of the substrate being substantially planar after formation of the at least one elongate groove; and a blocking layer covering the rear surface of the substrate adjacent the groove for permitting the transmission of light only through the groove to thereby create a sharp contrast between light incident on the groove and the blocking layer;

wherein light incident along the uniform layer of roughness of the arcuate groove surface exits the front surface of the substrate in an arcuate path with substantially uniform intensity to thereby create a three dimensional tubular appearance that is visually similar to neon tubing.

2. A display device according to claim 1, wherein the at least one groove comprises a plurality of groove sections, each groove section being shaped along a length thereof to represent an informational image.

3. A display device according to claim 2, further comprising a colored, translucent layer covering at least one of the said groove sections to thereby impart a color to said at least one groove section when illuminated.

4. A display device according to claim 3, wherein the diameter of said at least one groove is in the range of approximately 8 mm to 15 mm to thereby simulate a conventional diameter of neon tubing.

5. A display device according to claim 4, wherein the diameter of said at least one groove is in the range of approximately 10 mm to 12 mm.

6. A display device according to claim 1, wherein the diameter of the at least one groove is in the range of approximately 8 mm to 15 mm to thereby simulate a conventional diameter of the neon tubing.

7. A display device according to claim 6, wherein the diameter of the at least one groove is in the range of approximately 10 mm to 12 mm.

8. A display device according to claim 1, and further comprising a light source positioned to project light onto the blocking layer and the at least one groove.

9. A display device according to claim 1, wherein the layer of roughness formed within the groove surface is a non-prismatic layer of roughness.

10. A display device according to claim 9, wherein a colored translucent layer extends over the blocking layer and is spaced from said at least one continuous groove having said uniform non-prismatic layer of roughness to thereby impart a color to the three dimensional tubular appearance of said at least one groove independent of a viewer's position.

11. A display device according to claim 1, wherein the front surface of the substrate is substantially planar before formation of said at least one elongate groove.

* * * * *